US011786000B2

(12) United States Patent
Hussey et al.

(10) Patent No.: US 11,786,000 B2
(45) Date of Patent: Oct. 17, 2023

(54) INTERCHANGEABLE HEADWEAR SYSTEM FOR WATERPROOF MARINE GARMENTS

(71) Applicant: Zhik Pty Ltd, Artarmon (AU)

(72) Inventors: Thomas Kenneth Hussey, Balmain (AU); Bartosz Milczarczyk, Umina Beach (AU)

(73) Assignee: Zhik Pty Ltd, Artarmon (AU)

( * ) Notice: Subject to any disclaimer, the term of this patent is extended or adjusted under 35 U.S.C. 154(b) by 0 days.

(21) Appl. No.: 15/923,411

(22) Filed: Mar. 16, 2018

(65) Prior Publication Data

US 2018/0271196 A1 Sep. 27, 2018

(30) Foreign Application Priority Data

Mar. 23, 2017 (AU) ..... 2017901036

(51) Int. Cl.

| | |
|---|---|
| ***A42B 1/048*** | (2021.01) |
| ***A42B 1/046*** | (2021.01) |
| ***A41D 3/00*** | (2006.01) |
| ***A41D 15/00*** | (2006.01) |
| ***A41D 27/18*** | (2006.01) |
| ***A41D 13/11*** | (2006.01) |
| ***A41D 13/02*** | (2006.01) |
| ***A41D 13/012*** | (2006.01) |

(52) U.S. Cl.

CPC ..... *A42B 1/048* (2013.01); *A41D 3/00* (2013.01); *A41D 13/012* (2013.01); *A41D 13/02* (2013.01); *A41D 13/1153* (2013.01); *A41D 15/00* (2013.01); *A41D 27/18* (2013.01); *A42B 1/046* (2013.01); *A41D 2200/20* (2013.01); *A41D 2300/32* (2013.01); *A41D 2300/322* (2013.01)

(58) Field of Classification Search

CPC ..... A42B 1/048; A41D 3/00; A41D 12/012; A41D 12/02; A41D 12/1153; A41D 15/00; A41D 27/18

See application file for complete search history.

(56) References Cited

U.S. PATENT DOCUMENTS 2,690,565 A * 10/1954 Cornet ..... A41D 1/04 2/103
2,839,757 A * 6/1958 Gianola ..... A42B 1/045 2/205
2,870,452 A * 1/1959 De Grazia ..... A42B 1/048 2/203

(Continued)

OTHER PUBLICATIONS

Canadian Office Action Application No. 2,999,086 Completed: Jan. 28, 2019 4 Pages.

(Continued)

*Primary Examiner* — Richale L Quinn
(74) *Attorney, Agent, or Firm* — Nixon & Vanderhye P.C.

(57) ABSTRACT

An detachable headwear system with a waterproof garment having a chest portion and a neck portion, a headwear article, a zipper for connecting the waterproof garment to the headwear article, the zipper having first zipper teeth on the waterproof garment and second zipper teeth on the headwear article, the first zipper teeth being engageable with the second zipper teeth, the first zipper teeth beginning in a first area of the chest portion, extending at least partially around the neck portion, and ending in a second area of the chest portion.

20 Claims, 8 Drawing Sheets

(56) References Cited

U.S. PATENT DOCUMENTS 4,320,538 A * 3/1982 Saft ..... A41D 15/007 2/102
5,105,512 A * 4/1992 Aussedat ..... A44B 19/262 24/419
5,251,336 A * 10/1993 Nevins ..... A42B 1/046 2/173
5,339,466 A * 8/1994 McMullen ..... A41D 13/05 2/202
6,263,509 B1 * 7/2001 Bowen ..... A41D 13/05 2/108
6,370,692 B1 * 4/2002 Duyn ..... A41D 3/02 2/86
6,374,418 B1 * 4/2002 Rindle ..... A42B 1/048 2/202
6,532,596 B1 * 3/2003 Fosmo ..... A41B 13/10 2/202
6,654,963 B2 * 12/2003 Fayle ..... A41D 3/00 2/84
7,058,981 B2 * 6/2006 Clark ..... A41D 3/00 2/69
8,438,665 B2 * 5/2013 Roemer ..... A41D 3/00 2/84
2007/0186326 A1 * 8/2007 Myerscough ..... A41D 13/02 2/69
2014/0295734 A1 * 10/2014 Shashy ..... A41C 3/02 450/58
2014/0317829 A1 * 10/2014 Rolfe ..... A41D 3/00 2/84
2015/0082509 A1 * 3/2015 Davis ..... A41D 13/02 2/79
2017/0251733 A1 * 9/2017 Sorrentino ..... A41D 3/00
2018/0271196 A1 * 9/2018 Hussey ..... A42B 1/048
2018/0304106 A1 * 10/2018 O'Leary ..... A62B 17/006
2019/0099021 A1 * 4/2019 Li ..... A47G 9/1027
2019/0104775 A1 * 4/2019 Wood ..... A41D 13/0012

OTHER PUBLICATIONS

Ricardou, Francois Xavier, Voiles et voiliers, "A Two-In-One Smock!," The Marinepool Kingston II Smock, Published Oct. 5, 2009, 3 pages.

* cited by examiner

INTERCHANGEABLE HEADWEAR SYSTEM FOR WATERPROOF MARINE GARMENTS

TECHNICAL FIELD

This invention relates to an interchangeable headwear system for waterproof garments designed for sailing or other marine activities in variable weather conditions.

BACKGROUND

Waterproof garments used for sailing and other marine activities are commonly known in the art. These garments provide critical weather protection to sailors in rough seas and/or weather conditions.

The garments are commonly made from waterproof laminated or coated composite textiles joined by stitching and/or gluing. The seams are commonly made watertight by the application of a hot-melt adhesive tape.

An example of such a waterproof garment is a waterproof sailing suit known as a dry suit. The sailor is able to wear thermal garments underneath the suit for warmth and comfort, and the suit features water-tight seals at the neck, wrist and other openings to prevent the ingress of water. Full body dry suits generally have a large waterproof zipper to allow for donning and doffing of the garment. Other waterproof garments commonly used in marine sports include smocks and jackets that may also feature water-tight seals at the neck and/or wrist to prevent the ingress of water.

Most garments designed for offshore sailing feature a large collar that protrudes from the neck line of the garment to above the user's ears. The collars generally also feature a hood that can be deployed to provide additional protection. Whilst these collars and hood provide necessary protection in foul weather conditions, these large collar inhibit visibility and audibility of the sailor's surroundings, and also restrict movement when moving under sails, ropes, rails and other obstacles on the boat. For at least these reasons, many sailors prefer to wear garments without any collar or hood for conditions when the collar and hood are not critical for weather protection. This means that sailors are forced to carry two (2) or more different garments on the boat, which adds weight to the sailing vessel and also fills valuable storage space on board. In addition, sailors are also faced with difficulty donning and doffing the garments during sailing and an increased the risk of water entering and saturating their undergarments during this process. Alternately, a sailor may decide to not carry a garment with collar and hood protection, leaving them at risk in harsh conditions.

Removable hoods are known in the art whereby hoods are often attached to a garment collar by means of a zipper or other fastener. Whilst these removable hoods do allow for the bulkiness of the collar to be reduced, they do not allow for the adjustment of collar size or configuration. In addition, existing removable hood designs do not provide adequate waterproof protection on a sail boat as waves can often hit the back of the wearer and pass through the zipper and over the collar into the garment.

It is desirable to provide a system that enables protective headwear configurations including collars, hoods and masks to be interchanged on a sailing garment whilst maintaining the waterproofness of the garment.

SUMMARY

The present invention discloses an interchangeable headwear system for waterproof garments intended for sailing or other marine activities. The system allows the attachment of different protective headwear configurations to provide suitable protection to the sailor depending on sailing conditions. The system also allows the removal and re-attachment of various headwear articles without doffing the garment and without negating the waterproofness of the body of the garment.

The interchangeable headwear system is provided on a waterproof garment such as smock or dry suit that is constructed from a waterproof textile and preferably seam sealed by means of a hot-melt waterproof seam tape or other means known in the art.

The system includes a neck seal fixed to the garment that provides a water tight seal around the wearer's neck to prevent the ingress of water into the garment.

Suitable watertight seals for the neck seal are known in the art and are generally in the form of a conical tube with a first narrower opening to seal around the neck and a second larger opening joined to the garment. The seals are generally comprised of an elastomeric rubber material that provides adequate elongation so that the first opening can be stretched over the head when donning and doffing the garment and fit securely around the neck to provide a substantially water-tight seal. The second opening is attached to the waterproof textile body of the garment at a seam that is sealed by means of a hot-melt waterproof seam tape or other means known in the art. The circumference of the second opening is provided to be larger than that of the users head to allow body fabric with no-stretch to be used and still allow the users head to be passed through the neck seal.

Other suitable neck seals known in the art include adjustable cuffs comprised of a waterproof rubber, PVC, neoprene or Polyurethane coated textile or other material with a hook and loop adjustable fastener that allows the seal to be opened for donning and doffing and then sealed tight around the neck during use.

An attachment method of the headwear system is provided by a zipper that begins and finishes in the chest area of the garment and encircles around the neck of the garment.

The zipper attachment is an open-ended type zipper known in the art that features two (2) elements each comprising a tape and zipper teeth that zip together using a single slider. The elements can be completely separated from one another and reattached by means of the slider.

The first element of the zipper is fixed to the garment along its length that begins and finishes in the chest area of the garment and encircles around the neck of the garment. The first zipper element is preferably stitched or bonded to the waterproof body textile of the garment on the outer side of the neck seam where the neck seal is attached.

The first zipper element is positioned and fixed to the garment to provide small openings at the front and rear of the garment to allow water that enters to collar to drain out instead of building between the garment body and collar.

The second zipper element is fixed to the each removable headwear article. Each headwear article features its own second zipper element that can be attached to the first zipper element of the garment.

An additional fastening means is also optionally provided in the chest area of the garment to allow ease of positioning and alignment of the collar when engaging the 2 elements of the zipper.

A securing strap can also be optionally provided to secure the zipper slider in the closed position to prevent the collar unintentionally unfastening during use.

Headwear articles are provided in different configurations to allow the wearer to interchange during use of the garment to suit different weather conditions, type of activity or user preference.

In one configuration suitable for mild weather conditions or during activities where the sailor requires high visibility and maximum maneuverability, the user can wear the garment without any headwear article attached thereby providing maximum freedom of vision and movement.

In other configurations, headwear articles featuring a collar can be provided. Collars of various height and shape can be provided to suit specific conditions and user requirements. For conditions where a moderate degree of protection is required and/or good visibility and maneuverability is required, a headwear article comprising a lower height collar can be provided that affords some wind and water protection to the neck and lower face. For conditions where a higher degree of protection is required, a headwear article featuring a high collar can be provided that affords increased wind and water protection.

The headwear articles featuring a collar are preferably provided with a seam at the base of the collar that joins to a shoulder panel that spans between the base of the collar and the zipper. The shoulder panel allows a closer fit of the collar by allowing a small circumference of the base of the collar compared to the circumference of the attachment zipper.

The collars preferably feature an opening at the front of the collar to allow the user to open the collar for increased ventilation and/or visibility. The opening is preferably provided with hook and loop fasteners positioned on a first placket and a second placket to allow the collar to be secured closed. The plackets may extend down to form part of the shoulder panel to allow a larger opening of the collar.

The headwear articles may feature an additional face shield providing increased protection. The articles may also include a hood constructed of a waterproof textile that is fixed and optionally configured to be stowed in a pouch or position to sit behind the wearers head when not in use.

In another configuration, a form fitting hooded mask comprising a stretchable waterproof textile is provided. The hooded mask includes at least one opening for vision in the eye area and optional breathing holes or area of highly air permeable material near the mouth. The hooded mask features a flared pattern at the base of the neck confirming to the shoulders of the wearer that extends to the zipper attachment.

DETAILED DESCRIPTION

Examples of garments commonly used for sailing as well as many other marine sports and activities that are compatible with the present interchangeable headwear system are shown in FIGS. 1 and 2.

Figure 1A:
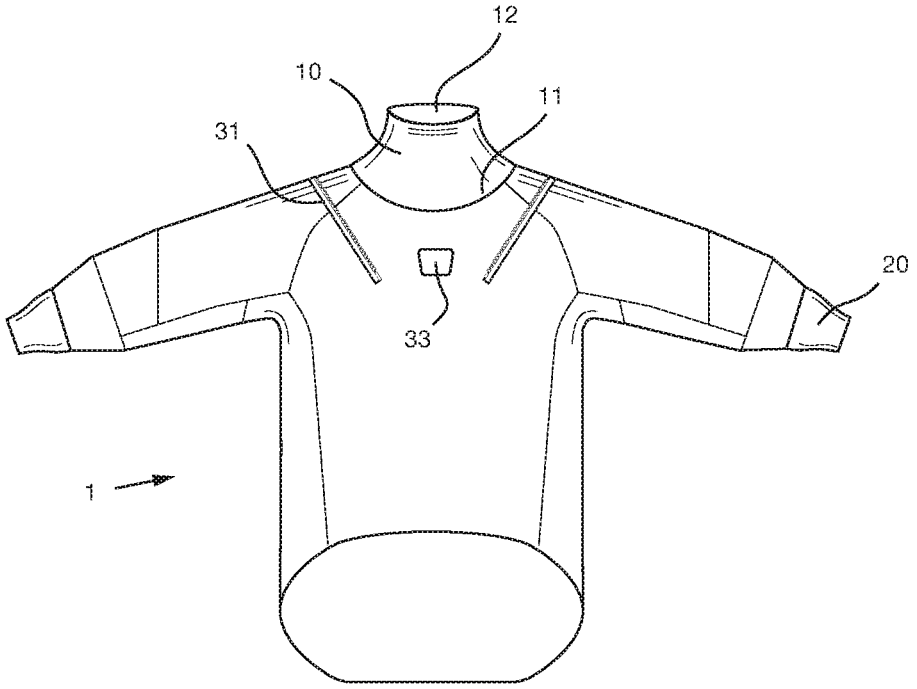
FIGS. 1A & 1B are a front view and rear view of a waterproof smock featuring the headwear attachment system without any headwear article attached.
Figure 1B:
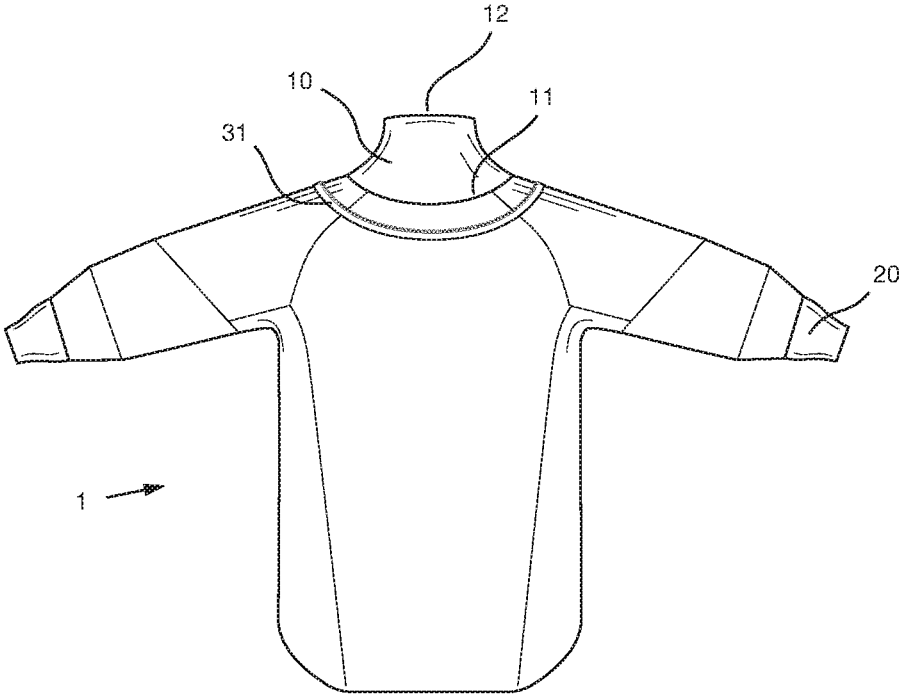

FIGS. 1A and 1B show a waterproof smock intended for sailing featuring a neck seal 10 and wrist seals 20. The smock is intended to be worn in conjunction with a waterproof trouser or salopette to provide waterproof protection.

Figure 2A:
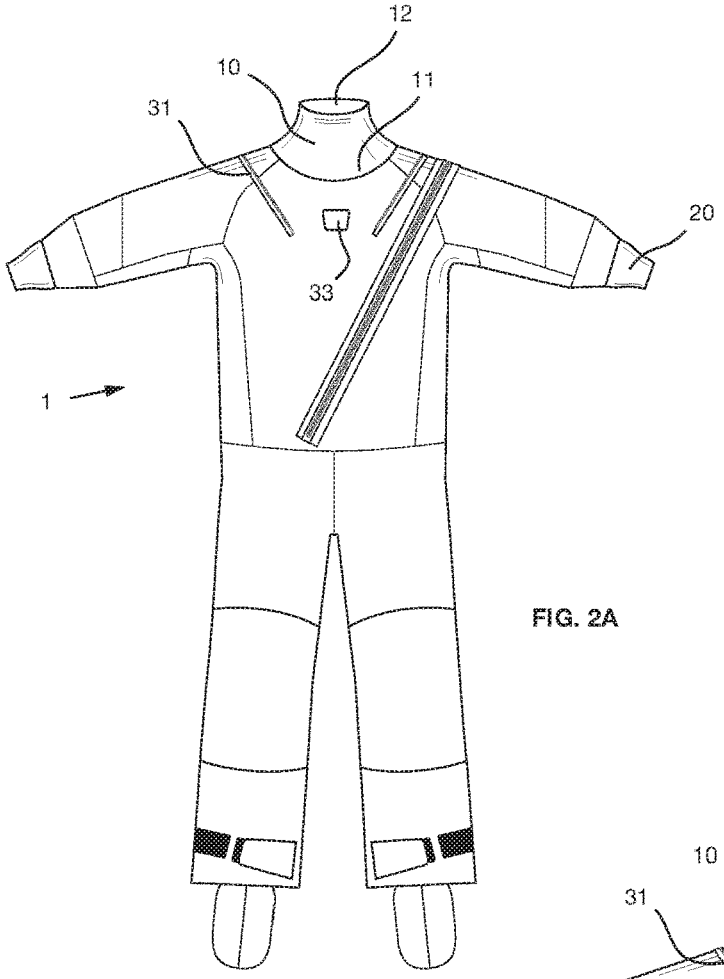
FIGS. 2A & 2B are a front view and rear view of a waterproof drysuit featuring the headwear attachment system without any headwear article attached.
Figure 2B:
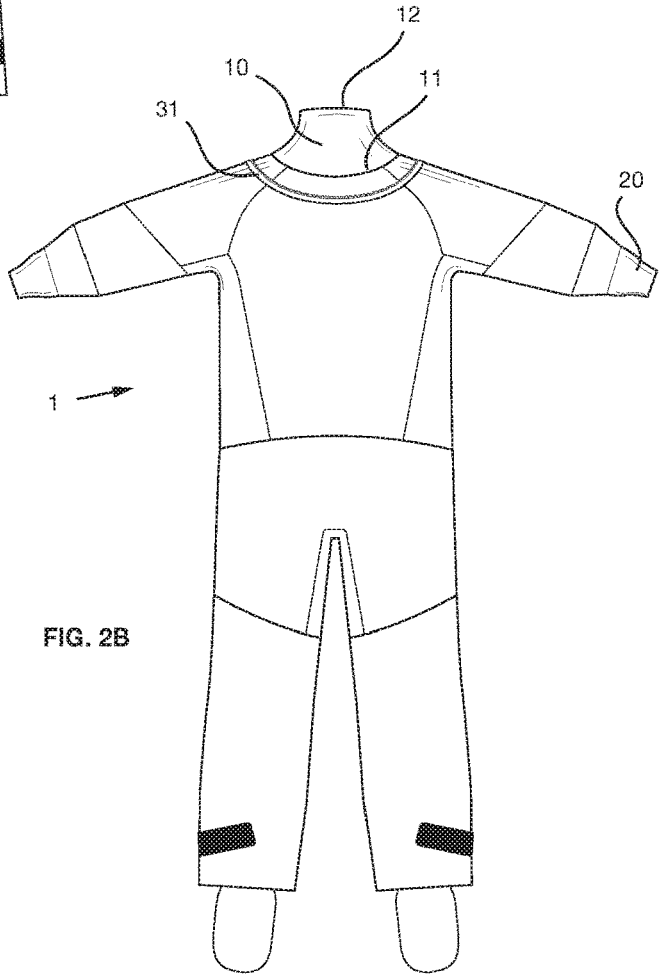

FIGS. 2A and 2B show a waterproof dry suit featuring a neck seal 10 and wrist seals 20. The dry suit is an entirely watertight garment that is worn over undergarments and provides complete waterproof protection to the user.

The garments 1 are generally made from a waterproof textile joined at seams by a means of a waterproof hot-melt adhesive seam tape or other method known in the art.

The present interchangeable headwear system includes a neck seal 10 fixed to a garment 1 that provides a water tight seal around the wearers neck to prevent the ingress of water into the garment. The neck seal 10 is joined to garment 1 at a neck seam 11.

Suitable watertight seals for the neck seal are known in the art and are generally in the form of a conical tube with a first narrower opening 12 to seal around the neck and a second larger opening joined the garment at neck seam 11. The seals are generally comprised of an elastomeric rubber material that provides adequate elongation so that the first opening can be stretched over the head when donning and doffing the garment and fit securely around the neck to provide a substantially water-tight seal.

Other suitable neck seals known in the art include adjustable cuffs comprised of a waterproof rubber, PVC, neoprene or Polyurethane coated textile or other material with a hook and loop adjustable fastener that allows the seal to be opened for donning and doffing and then sealed tight around the neck during use.

An attachment method of the headwear system is provided by a zipper 30 that begins and finishes in the chest area of the garment 1 and encircles around the neck of the garment.

The zipper 30 is an open-ended type zipper known in the art that features a first and second element each comprising a tape and teeth that zip together using a single slider. The elements can be completely separated from one another and reattached by means of the slider.

The first element 31 of the zipper is fixed to the garment 1, the start and finishing ends of the zipper positioned in the chest area of the garment with the length of the zipper encircling around the neck of the garment.

In a preferred embodiment, an additional fastening means is also provided in the chest area of the garment to allow ease of positioning and alignment of the headwear items when engaging the zipper elements. The fastening means is preferably in the form of a hook and loop fastener commonly known in the art.

Figure 3A:
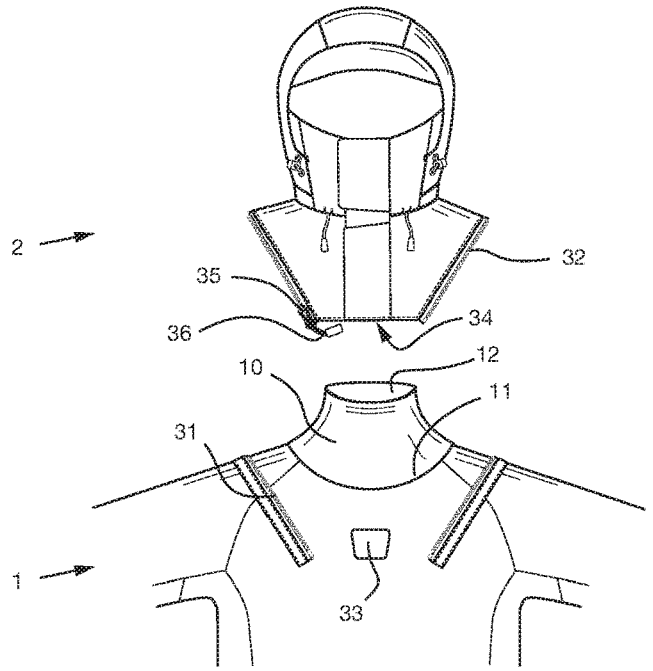
FIGS. 3A, 3B & 3C are front detail views of a waterproof garment featuring the headwear attachment system showing steps of attaching an article of a headwear.
Figure 3B:
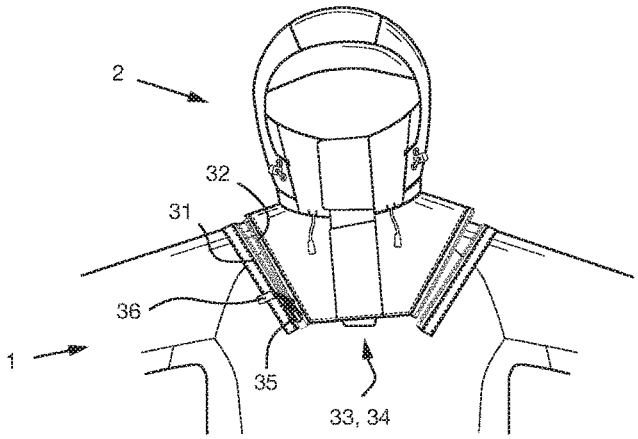
Figure 3C:
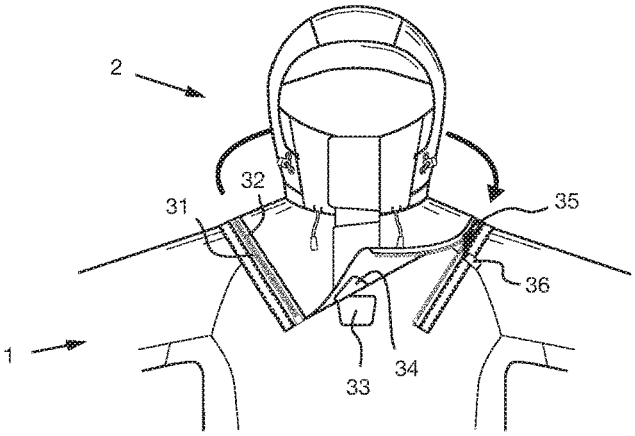

The process in which an article of headwear 2 is attached to the garment 1 is shown in FIGS. 3A, 3B & 3C.

The article of headwear 2 features a second zipper element 32 configured to attach to the first zipper element 31 of the garment. A zipper slider 35 is provided and is preferably permanently attached to the headwear zipper element 32, with each headwear element having its own zipper slider. This reduces bulk of the garment 1 and prevents the risk of the zipper slider breaking or sliding around the first zipper element 31 when an article of headwear is not attached. In an alternative embodiment, slider 35 may be attached to the first zipper element 31 attached to the garment 1.

To attach an article of headwear 2 to the garment 1, the article of headwear is first positioned over the users head so that the first and second zipper elements roughly align. An insert pin provided on the first zipper element 31 is inserted into the zipper slider 35 and a retaining box of the second zipper element 32 to connect the starting end of the zipper as shown in FIG. 3B. A hook and loop fastener consisting of a panel of loops 33 fixed to the chest and panel of hooks 34 fixed on the underside of the article of headwear can also be used to hold the article of headwear in place to allow for easier insertion of the insert pin of the zipper. The zipper slider is then pulled over the shoulder, around the back of the neck and over the opposite should towards the chest area thereby connecting the two elements of the zipper joining the article of headwear 2 to the garment 1.

The first element 31 of the zipper 30 is positioned and fixed to the garment 1 on the outer side of the neck seam 11 where the neck seal 10 is attached. The first zipper element 31 is positioned on the garment 1 to allow for the user to zip or unzip the zipper using a single hand and motion. The start and finish of the zipper element 31 is preferably positioned in the chest area of the garment between 50 mm and 300 mm vertically down from the front neck seam so that the user can look down and easily see the zipper start and end to allow for easy alignment and insertion of the insertion pin of the first zipper element 31 into the zipper slider and retaining box of the second zipper element 32. The first zipper element 31 encircles the neck of the garment 1 and is positioned as close to the center rear neck seam as possible so that slider 35 can be reached by the user whilst zipping or unzipping the zipper around the rear of the neck.

An optional puller 36 can also be fixed to the zipper slider 35 to allow for easier reach to the zipper slider by the user whilst zipping up and down the zipper around the back of the neck.

The first zipper element 31 is preferably stitched or bonded to the waterproof body textile at least 20 mm away from the neck seam 11 to allow for easy application of a hot-melt seam tape around the neck seam and/or stitching of the zipper, to reduce bulk at the neck seam and also to allow for the ability for the neck seal to be more easily replaced if it is damaged during use.

Figure 4A:
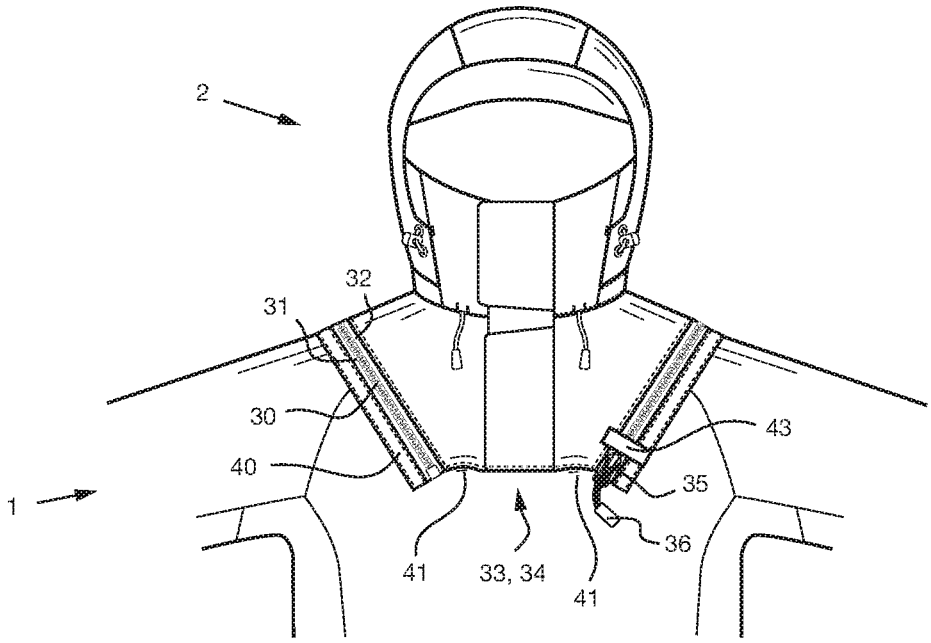
FIGS. 4A & 4B are a front view and rear detail view of a waterproof garment featuring the headwear attachment system with a headwear article attached.
Figure 4B:
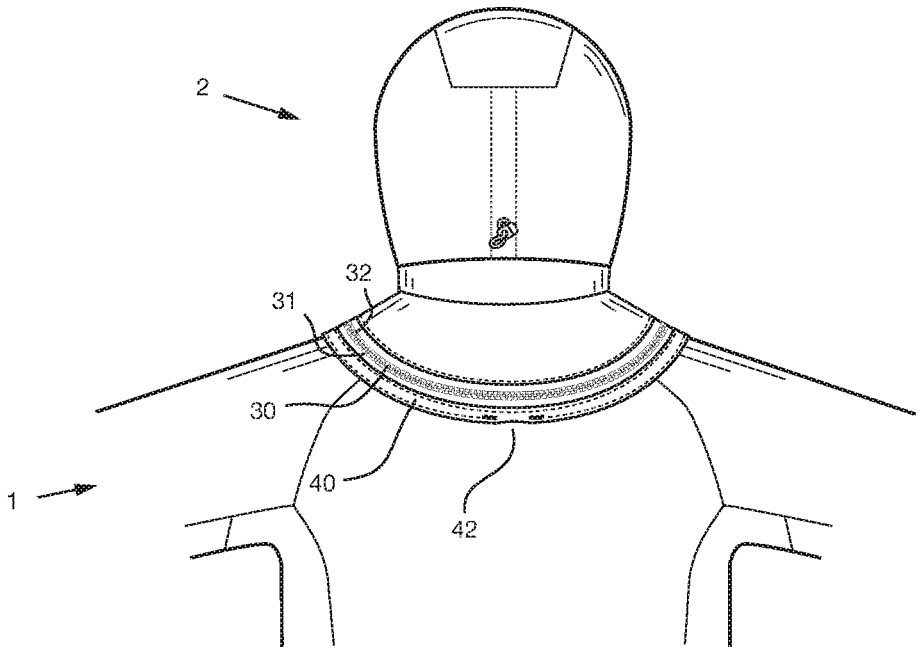

In a preferred embodiment as shown in FIGS. 4A & 4B, the first zipper element 31 is fixed to a connecting panel 40 that is joined to the garment 1 by stitching or bonding. The connecting panel 40 provides a distance between the rigid teeth components and the attachment point with the garment so that the rigid teeth do not interfere with sewing, seam taping and/or bonding equipment during assembly.

In a preferred embodiment also shown in FIGS. 4A and 4B, drainage holes are provided to allow for any water that enters and gathers between the article of headgear and garment to be released. Drainage can be provided by allowing one or more gaps 41 between the start and finish of zipper element 31 and fastener 33. Drainage may also be provided by allowing one or more gaps 42 in the stitching where zipper element 31 or connecting panel 40 are fixed to the garment 1.

In a preferred embodiment also shown in FIG. 4A, a securing strap 43 is provided to secure the zipper slider in the closed position to prevent the collar unintentionally unfastening during use.

FIGS. 5A-C, 6A-B, 7A-D & 8A-B show various articles of headwear 2 that can be provided and can be interchanged during use of the garment to suit different weather conditions, activity or user preference. Each article features its own second zipper element 32 that can be attached to the first zipper element 31 of the garment.

In one configuration suitable for mild weather conditions or during activities where the sailor requires high visibility and maximum maneuverability, the user can wear the garment without any headwear attachment thereby providing maximum freedom of vision and movement.

Articles of headwear comprising a collar are shown in FIGS. 5A-C and 6A-B. Various collar height and shape configurations are possible to suit specific conditions and user requirements.

The headwear articles comprising a collar are preferably provided with a seam 51 at the base of the collar 50 that joins to a shoulder panel 52 that spans between the base of the collar and the second zipper element 32. The shoulder panel allows a closer fit of the collar by allowing a small circumference of the base of the collar compared to the circumference of the zipper 30.

Figure 5A:
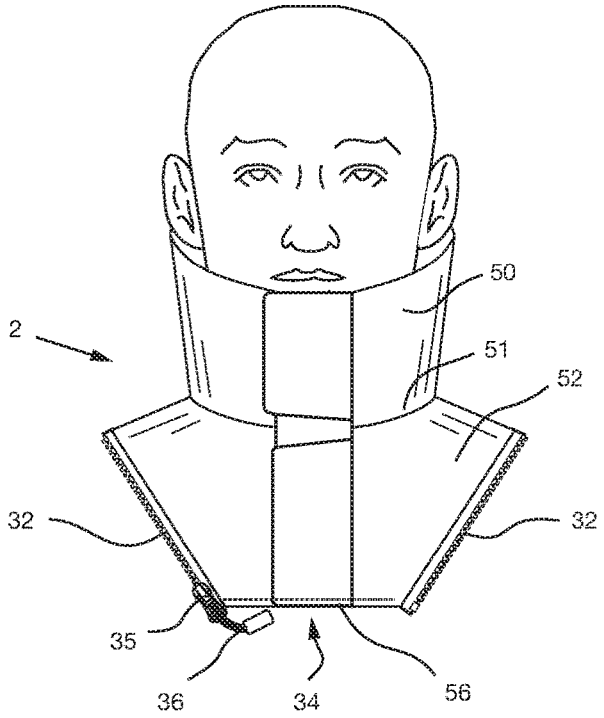
FIGS. 5A & 5B are a front and rear detail view of a headwear article featuring a collar and placket opening.
Figure 5B:
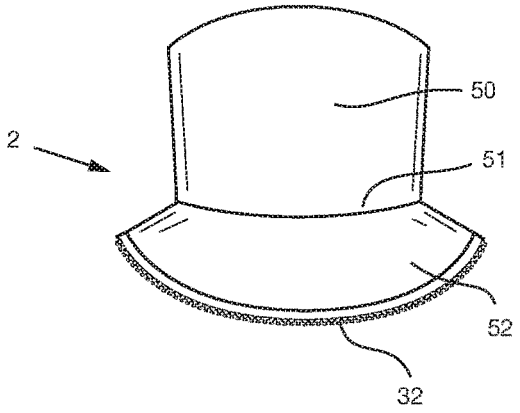
Figure 5C:
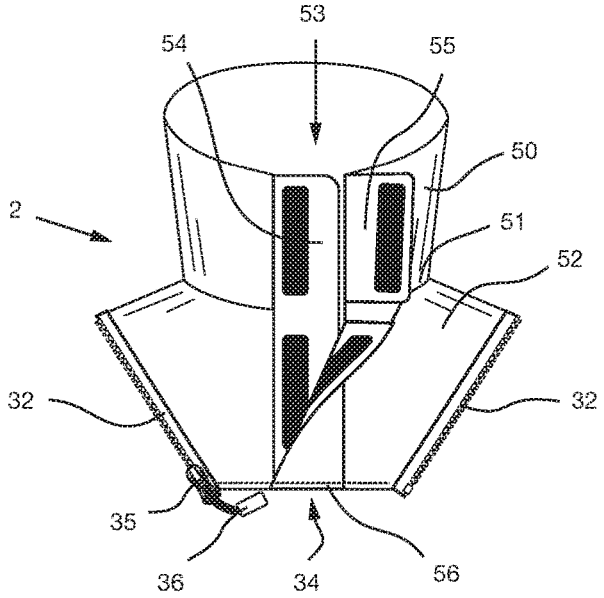
FIG. 5C is a front detail view of the headwear article shown in FIGS. 5A & 5B with placket open.

The collars preferably feature an opening at the front of the collar 53 to allow the user to open the collar for increased ventilation and/or visibility as shown in FIG. 5C. The opening is preferably provided with hook and loop fasteners positioned on a first placket 54 and a second placket 55 to allow the collar to be secured closed. The plackets preferably extend down to form part of the shoulder panel to allow a larger opening of the collar and are joined together at the base of the plackets 56.

For conditions where a moderate degree of protection is required and/or good visibility, audibility and maneuverability is required, a headwear attachment comprising with a lower height collar can be provided as shown in FIGS. 5A, 5B and 5C. In this configuration the collar is sized so that the top of the collar is positioned below the ears.

Figure 6A:
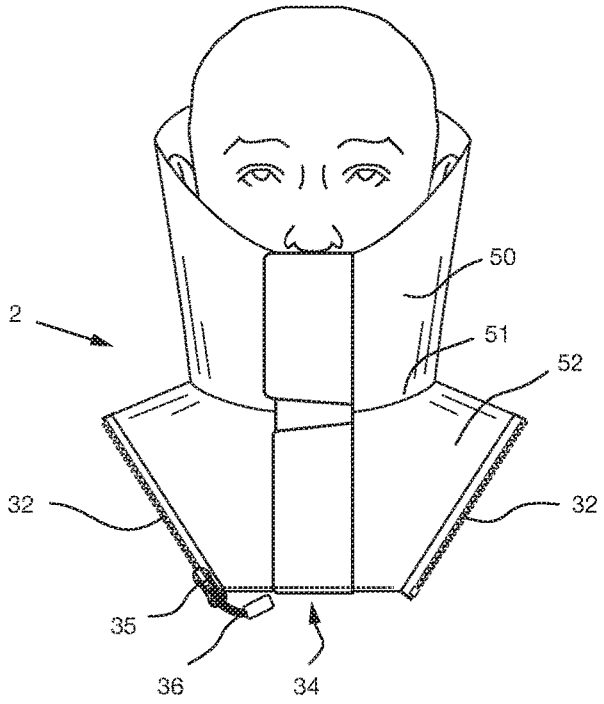
FIGS. 6A & 6B are a front and rear detail view of a headwear article featuring a collar and placket opening.
Figure 6B:
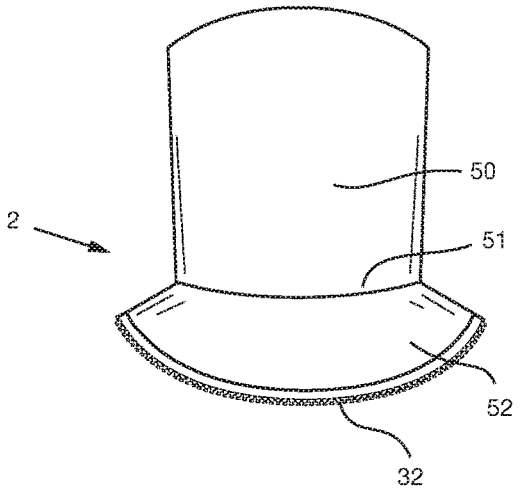

For conditions where a higher degree of protection is required, a headwear article featuring a high collar as shown in FIGS. 6A and 6B can be provided. The high collar is sized so that the collar substantially covers the ears.

Figure 7A:
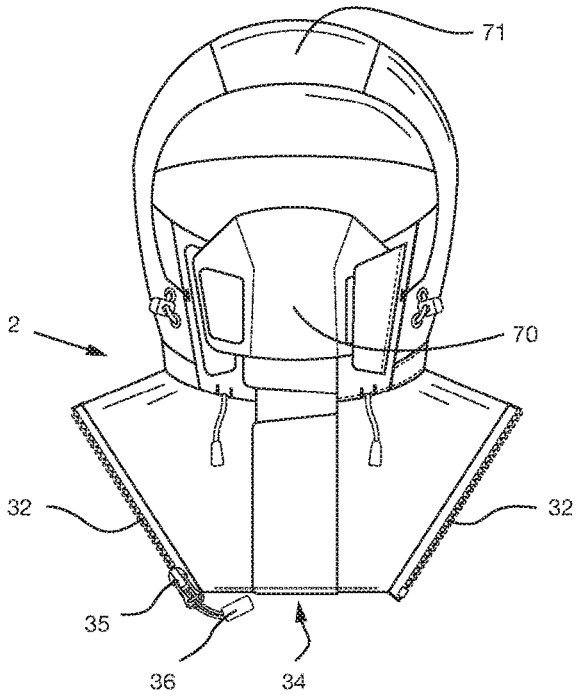
FIGS. 7A & 7B are a front and rear detail view of a headwear article featuring a collar and placket opening, attached hood and face shield.
Figure 7B:
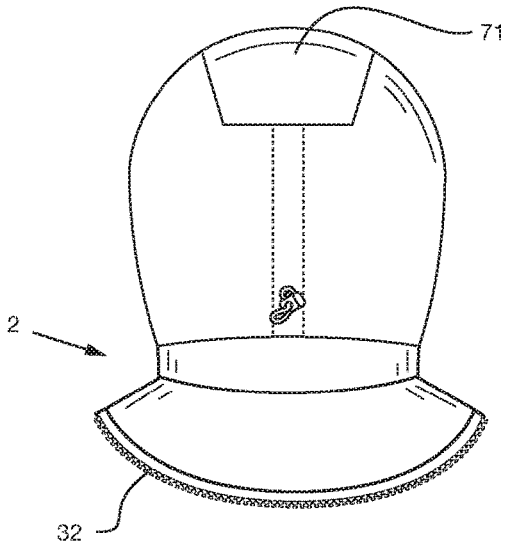
Figure 7C:
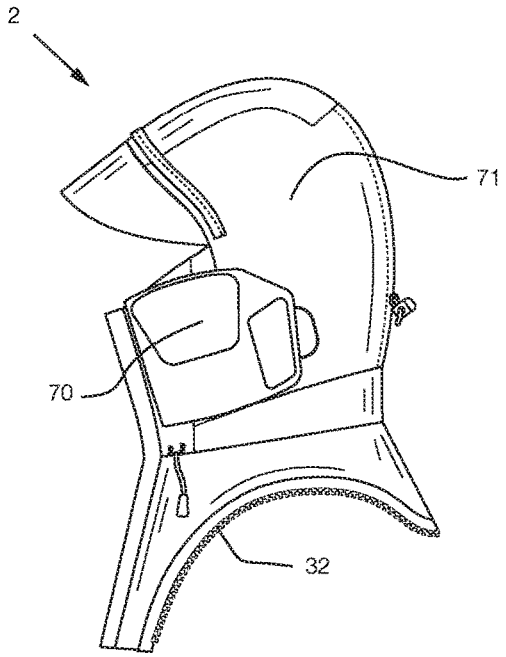
FIG. 7C is a side detail view of the headwear article shown in FIG. 7A with face shield stowed on the side of the collar.
Figure 7D:
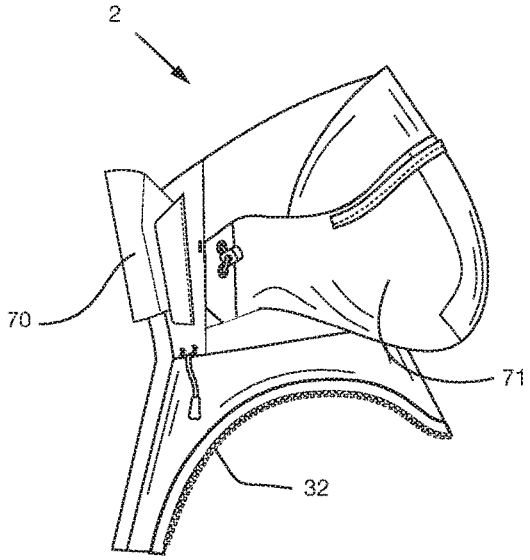
FIG. 7D is a side detail view of the headwear article shown in FIG. 7A with hood stowed behind the collar.

In a preferred embodiment shown in FIGS. 7A, 7B, 7C and 7D, an article of headwear includes a face shield 70 that be secured over the mouth and nose of the user. The face shield can be optionally secured to the side of the collar using a hook and loop fastener or other attachment means when not required, as shown in FIG. 7C.

In another preferred embodiment shown in FIGS. 7A, 7B, 7C and 7D, the headwear article includes a hood 71 to provide increased protection. The hood is preferably constructed from a waterproof textile that is fixed to the collar. The hood is also preferably configured to be stowed in a pouch or positioned to sit behind the wearers head when not in use, as shown in FIG. 7B. In an alternative embodiment, a hood may be provided as a headwear article that attaches to the garment 1 without a collar.

Figure 8A:
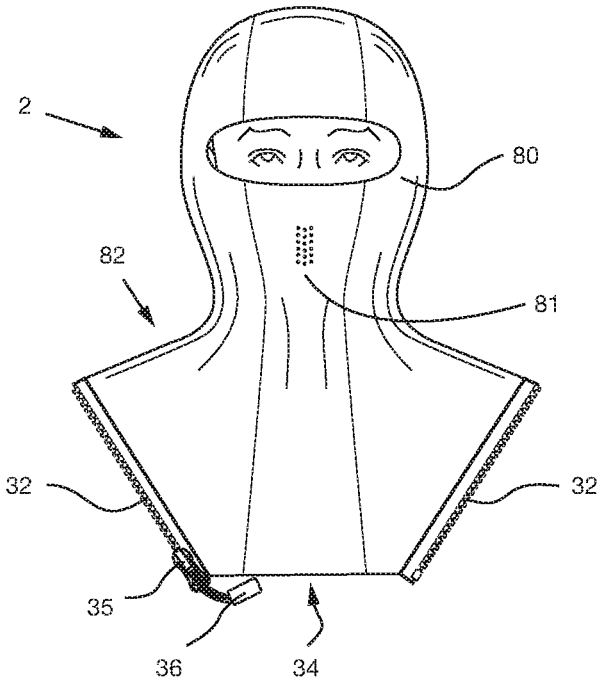
FIGS. 8A & 8B are a front and rear detail view of a headwear article comprising a form fitting hooded mask.
Figure 8B:
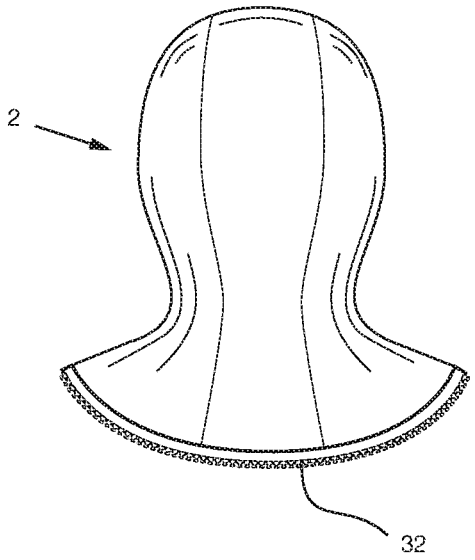

In another configuration, an article of headwear 2 is provided in the form of a form fitting hooded mask as shown in FIGS. 8A and 8B. The mask is preferably comprised a stretchable waterproof textile such as a neoprene foam and textile composite and/or waterproof membrane and textile composite. The hooded mask preferably includes at least one opening for vision 80 and optional breathing holes 81 or area of highly air permeable material near the mouth. The hooded mask features a flared shape 82 at the base of the neck confirming to the shoulders of the wearer that extends to the second zipper element 32.

While several embodiments have been disclosed, it will be apparent to those of ordinary skill in the art that aspects of the present invention include many more embodiments and implementations. Accordingly, aspects of the present invention are not to be restricted except in light of the attached claims and their equivalents. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A detachable headwear system, comprising:

a waterproof garment having a chest portion and a neck portion;

a headwear article;

a zipper for connecting the waterproof garment to the headwear article, the zipper having first zipper teeth on the waterproof garment and second zipper teeth on the headwear article, the first zipper teeth being engageable with the second zipper teeth;

the first zipper teeth beginning in a first area of the chest portion, extending at least partially around the neck portion, and ending in a second area of the chest portion the headwear article has a collar, the collar having a first set of hook and loop fasteners positioned on a first placket and a second placket, such that when the hook and loop fasteners are mated the plackets cover the mouth region of a wearer;

the headwear article further comprising a second set of hook and loop fasteners configurable to be mated relatively below the first set of hook and loop fasteners at the neck of a wearer;

the second set of hook and loop fasteners extends longitudinally downward to allow for continuous longitudinal mating of the second set of hook and loop fasteners such that a barrier is formed against the ingress of liquids; and wherein a portion of the zipper on the chest portion is adapted to remain uncovered by the headwear article when the headwear article is connected to the garment, such that manipulation of the portion of the zipper is unobstructed;

wherein when the headwear article is mounted to the waterproof garment at least one drainage hole is formed between the headwear article and the waterproof garment adapted to allow for water that enters between the waterproof garment and the headwear article to be released.

2. The detachable headwear system of claim 1, wherein the headwear article is a first headwear article, the system further including a second headwear article, different from the first headwear article, and wherein the second headwear article is configured to be attached to the waterproof garment when the first headwear article is detached from the waterproof garment.

3. The detachable headwear system of claim 1, wherein the first area of the chest portion is between 50 mm and 300 mm down from a front neck seam and the second area of the chest portion is between 50 mm and 300 mm down from the front neck seam.

4. The detachable headwear system of claim 1, wherein the first zipper teeth extend from a first zipper tape that extends continuously between the first area of the chest portion and the second area of the chest portion.

5. The detachable headwear system of claim 1, wherein a fastener holds the headwear article to the chest area of the waterproof garment.

6. The detachable headwear system of claim 5, wherein the fastener is a hook and loop fastener.

7. The detachable headwear system of claim 1, wherein the headwear article includes a face shield.

8. The detachable headwear system of claim 7, wherein the face shield is configurable to extend over the first placket and second placket.

9. The detachable headwear system of claim 1, wherein the headwear article includes a hood.

10. The detachable headwear system of claim 9, wherein the hood is fixed to the collar, such that the collar is configured to be inside the hood when the hood is in an in-use position.

11. The detachable headwear system of claim 1, wherein the headwear article includes a hooded mask.

12. The detachable headwear system of claim 1, wherein the waterproof garment is a sailing smock.

13. The detachable headwear system of claim 1, wherein the waterproof garment is a waterproof dry suit.

14. The detachable headwear system of claim 1, wherein a strap extends over the zipper generally perpendicularly relative to a longitudinal direction of the zipper.

15. The detachable headwear system of claim 1, wherein the headwear article further includes a face shield securable over the nose of a wearer.

16. The detachable headwear system of claim 1, wherein a seam is provided at a base of the collar joined to a shoulder panel of the headwear article, such that the shoulder panel can provide a closer fit with the waterproof garment.

17. The detachable headwear system of claim 1, wherein the first set of hook and loop fasteners extends longitudinally down the placket and allows for continuous longitudinal mating of the first set of hook and loop fasteners such that ingress of liquids is reduced.

18. The detachable headwear system of claim 1, wherein at least one of the first placket and the second placket is contoured between the first set of hook and loop fasteners and the second set of hook and loop fasteners.

19. The detachable headwear system of claim 1, wherein the headwear article extends down the chest portion so as to fully cover a mating means below the headwear article.

20. The detachable headwear system of claim 1, wherein the headwear article is mounted over a neck seal on the waterproof garment.

* * * * *